US006428590B1

(12) United States Patent
Lehman et al.

(10) Patent No.: US 6,428,590 B1
(45) **Date of Patent: *Aug. 6, 2002**

(54) FILTER SYSTEM FOR MOBILE DEBRIS COLLECTION MACHINE

(75) Inventors: Ronald W. Lehman, Brooklyn Park; Gregory J. Engel, Plymouth, both of MN (US)

(73) Assignee: Tennant Company, Minneapolis, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/476,563

(22) Filed: Jan. 3, 2000

(51) Int. Cl.[7] ..... B01D 50/00

(52) U.S. Cl. ..... 55/334; 55/335; 55/DIG. 2; 55/DIG. 3; 15/352; 15/353

(58) Field of Search ..... 55/334, 335, DIG. 2, 55/DIG. 3; 15/352, 353

(56) References Cited

U.S. PATENT DOCUMENTS

| | | | | |
|---|---|---|---|---|
| 2,701,377 A | | 2/1955 | Luksch et al. | |
| 2,719,596 A | | 10/1955 | Kent et al. | |
| 3,006,021 A | | 10/1961 | Patch | |
| 3,173,777 A | | 3/1965 | Tammy | |
| 3,588,944 A | | 6/1971 | Fromknecht et al. | |
| 3,710,412 A | | 1/1973 | Hollowell | 15/340 |
| 3,842,461 A | * | 10/1974 | Wurster | |
| 4,007,026 A | | 2/1977 | Groh | |
| 4,366,594 A | | 1/1983 | Hyams | 15/314 |
| 4,533,371 A | | 8/1985 | Nakamura | |
| 4,735,639 A | * | 4/1988 | Johnstone | |
| 4,811,453 A | | 3/1989 | Lubraniecki | |
| 4,820,315 A | * | 4/1989 | DeMarco | |
| 4,838,907 A | | 6/1989 | Perry | |
| 4,868,948 A | | 9/1989 | Arnold | 15/340 |
| 4,894,881 A | | 1/1990 | Palmer et al. | |
| 5,058,235 A | | 10/1991 | Charky | 15/340 |
| 5,089,037 A | * | 2/1992 | Marsolais | |
| 5,090,083 A | | 2/1992 | Wulff | |
| 5,129,124 A | | 7/1992 | Gamou et al. | |
| 5,129,125 A | | 7/1992 | Gamou et al. | |
| 5,138,742 A | | 8/1992 | Charky | 15/340.1 |
| 5,500,979 A | | 3/1996 | Worwag | |
| 5,519,915 A | | 5/1996 | Hollowell | 15/354 |
| 5,588,179 A | | 12/1996 | Bargiel et al. | |
| 5,771,532 A | | 6/1998 | Munnoch | |
| 5,840,103 A | | 11/1998 | Dyson | |
| 5,867,863 A | | 2/1999 | McCormick | |
| 5,983,447 A | * | 11/1999 | Boomgarden | |
| 5,996,173 A | | 12/1999 | Engel et al. | 15/352 |
| 5,996,174 A | | 12/1999 | Boomgaarden et al. | 15/354 |
| 6,041,471 A | | 3/2000 | Charky et al. | 15/320 |
| 6,092,261 A | | 7/2000 | Boomgaarden | 15/323 |
| 6,122,797 A | * | 9/2000 | Vanderlinden | |
| 6,192,550 B1 | * | 2/2001 | Hamada et al. | |

FOREIGN PATENT DOCUMENTS

| | | |
|---|---|---|
| FR | 7911367 | 4/1979 |
| FR | 2667086 A1 | 11/1989 |
| FR | 2655071 A1 | 9/1990 |

* cited by examiner

*Primary Examiner*—Betsey Morrison Hoey
(74) *Attorney, Agent, or Firm*—Fulbright & Jaworski L.L.P.

(57) ABSTRACT

A mobile debris collection machine which has an improved filter system includes a chassis, wheels for supporting the chassis, an operator controlled debris pickup on the chassis and a debris container on the chassis. There is a vacuum system for carrying debris from the pickup to the container, with the vacuum system including a vacuum fan located above the debris container for creating an air stream that moves dust and debris from the pickup toward the container. A filter system for removing dust and debris from the airstream includes a first filter stage formed of a rotating perforated member, a second filter stage that is located downstream of the vacuum fan and includes a mesh filter bag, and a third filter stage, located downstream from the second filter stage and including a pleated panel filter.

16 Claims, 2 Drawing Sheets

28
52
40
46
42
44
50
48
12
62
54
56
64
68
58
60
74
66
76
78
60
72
70
80
82

FILTER SYSTEM FOR MOBILE DEBRIS COLLECTION MACHINE

THE FIELD OF THE INVENTION

The present invention relates to an improved filter system for use in a mobile debris collection machine such as that manufactured by the Tennant Company of Minneapolis, Minnesota and sold under the designation ATLV 4300. It is important in mobile debris and dust collection machines to provide a filter system which will remove dust from the air stream before it is discharged into the atmosphere. Normally, debris collection machines use a high volume of air flow, such being necessary to insure adequate pickup of dust and debris. It is important that the air discharged from the machine be as dust-free as possible. Concurrent with the problem of removing dust is to provide a filter system which is sufficiently adequate that it does not require constant maintenance and removal of filter elements for cleaning. Further, any dust collection system which will easily clog will create a back pressure which can adversely affect vacuum performance and thus litter pickup. The present invention is addressed to the above described problems and specifically functions with a three stage dust and debris separation system which insures that the high volume of air flow will be adequately filtered before discharge and that the filter system will remain unclogged for a substantial period of machine use.

SUMMARY OF THE INVENTION

The present invention relates to an improved filter system for a debris collection machine.

A primary purpose of the invention is to provide a filter system which includes multiple stages, with each successive stage filtering smaller dust particles to the end that the air, when discharged from the machine, is as clean as reasonably possible.

Another purpose of the invention is to provide a dust filter system for the described environment in which the dust is collected in mesh filter bags which are used in conjunction with pleated panel filters.

Another purpose is to provide a filter system for a mobile debris collection machine which uses three separate filter stages, the first being upstream of the vacuum fan and separating debris, with the second and third stages being downstream of the vacuum fan and removing dust.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
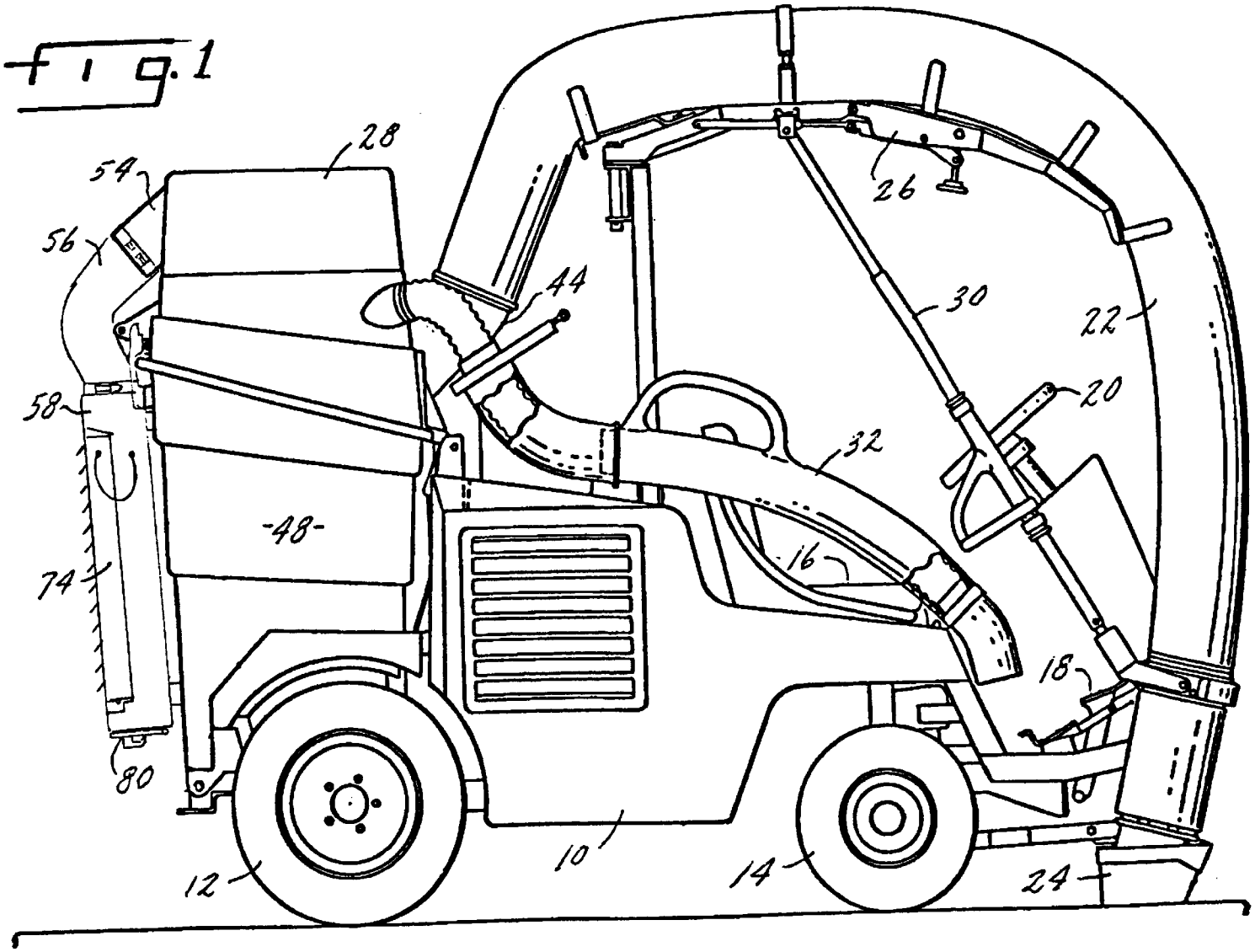
FIG. 1 is a side view of a mobile debris collection machine of the type described.

The present invention is specifically directed to a filter system for a mobile debris pickup machine. The system will be described in connection with a machine manufactured by the Tennant Company of Minneapolis, Minn. and described in detail in U.S. Pat. No. 5,983,447, the disclosure of which is herein incorporated by reference. It should be obvious that the multiple-stage filter system described and claimed herein is applicable to other types of mobile maintenance machines and the system is primarily directed to improved filtration of a high volume air stream which is required in machines such as those disclosed in the '447 patent.

The debris collection machine of the present invention includes a chassis 10 mounted on rear wheels 12 and front wheels 14. The chassis may support a driver seat 16 and there will be the typical controls for the driver to use in operating the vehicle. These may include foot pedals 18 and a steering wheel 20, as well as other conventional controls found on machines or vehicles of this type.

The vehicle includes both a pickup hose with supporting control elements and what is described as a pickup head. The hose is indicated at 22 and the pickup head is indicated at 24. The hose may be supported by a counter balance system indicated generally at 26 and in the position shown in the drawings provides the vacuum to the pickup head 24 by being mounted thereon. The opposite end of hose 22 is connected to a cover or housing 28 within which is positioned a vacuum fan. Thus, suction will be applied to the end of the hose connected to the vacuum fan, with the free end of the hose, when it is not mounted on the pickup head, being manipulated by the operator through a control arm 30 to pick up debris and/or litter. When the hose is mounted to the pickup head 24, vacuum is applied to that device for litter pickup. In addition, the vehicle includes a portable wand 32 which may be used by the operator when dismounted and thus, is available to pickup litter in areas not readily accessible to either the hose 22 or the pickup head 24. Both the wand 32 and the hose 22 are connected to the housing 28 through inlet openings therein. The overall machine is designed for pickup of litter, dust and debris and may do so either by the pickup head 24, the hose 22 when disconnected from the pickup head or the wand 32. All may be operated by the driver, either while seated or when dismounted when using the wand 32.

Within the housing indicated generally at 28 is a debris container, and as described in more detail in the '447 patent, this debris container may consist of side by side removable trash collection receptacles, either rigid containers or garden or lawn type bags. What is important is that the debris collection receptacles be located within the housing and be easily accessible by the operator for removal when full.

Figure 2:
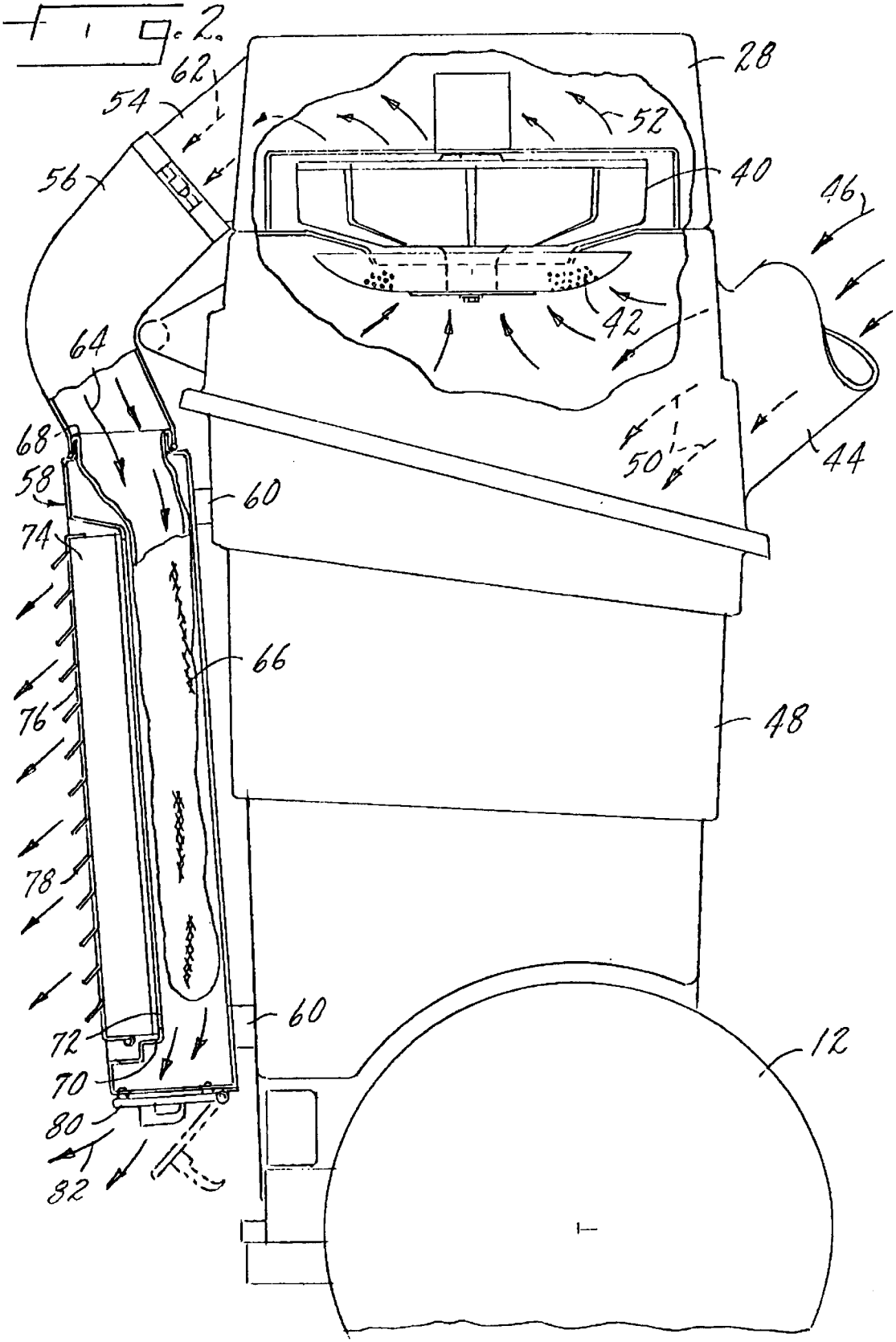
FIG. 2 is an enlarged side view, in part section, illustrating the dust collection system, vacuum fan and debris collection portions of the machine of FIG. 1.

Turning to FIG. 2, the housing 28 mounts a vacuum fan 40 which will be driven by the hydraulic system on the mobile vehicle described herein. At the underside of the vacuum fan 40 there is a dish shaped perforated plate 42, rotated by fan 40, and which as shown in FIG. 2, is directly in the air stream flow created by the vacuum fan. The dust and debris in the air stream will flow into a housing inlet 44 as shown by arrows 46. Inlet 44 may be connected to hose 22. The debris will drop down into the debris container diagrammatically illustrated by the bottom portion 48 of the housing 28. This debris will follow the path of arrows 50. The dust laden air will flow through the rotating perforated plate 42, which may be termed first stage filtration in that the openings in the perforated plate are not of a size to pass the debris which enters through the inlet 44 but will pass most dust particles. The dust laden air will pass through the vacuum fan, as indicated by arrows 52 and will flow outwardly through a housing outlet 54 into a conduit 56.

The conduit 56 is a part of a separate enclosure indicated generally at 58 and which is attached to the rear of the vehicle by brackets 60. The enclosure 58 will contain the second and third stage filters of the dust removal system. The dust laden air will follow the path of arrows 62 and 64 into a second filter stage which consists of a mesh filter bag indicated at 66. The openings in the mesh bag 66 will be smaller than the openings in the plate 42, thus insuring that a portion of the dust particles which pass through the first stage will be blocked for further air flow by the second stage. The mesh bag 66 may be attached at the top of enclosure 58 as shown where the bag is folded over the enclosure top as at 68. This provides for easy removal of the filter bag for replacement.

Within the housing 58 there is an interior wall 70 which has an opening 72 for the passage of air into a pleated filter element represented at 74. The air will pass through the pleated filter element and then will flow out through a plurality of openings 76 formed by the louvers 78. The pleated filter element forms the third filter stage and will be of a mesh which will remove particles finer than those removed by the mesh filter bag of the second stage.

At the bottom of enclosure 58 there is a hinged door 80 which forms a bypass between the second and third filter stages as indicated by the air flow represented by arrows 82.

To summarize, dust and debris from any one of the collection devices described will enter inlet 44 and the debris will fall down into the container 48 and the dust laden air will flow through the rotating perforated plate in the direction of arrows 52. The plate will insure that no litter flows into the vacuum fan. The air will then flow into the exterior enclosure where it is first filtered by the mesh bag 66, after which it will flow through the pleated filter panel 74 and then out through the openings 76. A bypass door is provided in the event that it is desired to bypass the third filter stage The container 48 may use rigid containers or it may use non permeable standard lawn and garden type bags. The mesh filter bag may be of any standard configuration and will have openings smaller than those in the perforated plate 42. In like manner, the pleated filter panel will have air passages smaller than those of the mesh bag to complete the filtering process. Both the filter bag and the pleated filter element are a part of an enclosure which is located outside of the housing for the trash and debris collection and thus may be easily removed and replaced by the operator with minimum down time of the machine.

Whereas the preferred form of the invention has been shown and described to herein, it should be realized that there may be many modifications, substitutions and alterations thereto.

The embodiments of the invention in which an exclusive property or privilege is claimed are defined as follows:

1. A mobile debris collection machine having an improved filter system including a chassis, a debris collection pickup on said chassis, a debris container on said chassis, a vacuum system for carrying dust and debris from said pickup to said container, said vacuum system including a housing associated with said container and having a dust and debris inlet opening therein above said container, an outlet in said housing, a vacuum fan for creating an air stream that moves dust and debris into said housing and moves dust out of said housing, and a filter system for removing dust from said air stream and depositing debris into said container, said filter system including a first filter stage having a rotating filter element that separates debris from said air stream and is located upstream of said vacuum fan, a second filter stage that is located downstream of said vacuum fan, and a third filter stage downstream of said second filter stage and positioned outside of said housing.

2. The mobile debris collection machine of claim 1 wherein said first filter stage includes a rotating filter element positioned adjacent to and driven by said vacuum fan.

3. The mobile debris collection machine of claim 2 wherein said rotating filter element is a dish-like plate attached to said vacuum fan and located above said container.

4. The mobile debris collection machine of claim 1 wherein said second filter stage is located outside of said container and consists of a mesh filter bag.

5. The mobile debris collection machine of claim 4 wherein said second filter stage is located within an enclosure positioned outside of said housing.

6. The mobile debris collection machine of claim 5 wherein said third filter stage is located within said enclosure.

7. The mobile debris collection machine of claim 6 including a bypass between said second and third filter stages.

8. The mobile debris collection machine of claim 7 wherein said bypass includes a door located at the bottom of said enclosure.

9. The mobile debris collection machine of claim 1 wherein said third filter stage includes a pleated filter element.

10. The mobile debris collection machine of claim 9 wherein said second filter stage includes a mesh filter bag positioned side by side with said pleated filter element.

11. A mobile debris collection machine having an improved filter system including a chassis, a debris pickup on said chassis, a debris container on said chassis, a vacuum system for carrying dust and debris from said pickup to said container, said vacuum system including a housing associated with said container and having a dust and debris inlet opening therein, an outlet in said housing, a vacuum fan for creating an air stream that moves dust and debris into said housing and moves dust out of said housing, a filter system for removing dust from said air stream and depositing debris into said container, said filter system including a first filter stage formed of a rotating filter element driven by said vacuum fan, a second filter stage, located downstream of said vacuum fan, and a third filter stage, located downstream of said second filter stage.

12. The mobile debris collection machine of claim 11 wherein the second filter stage includes a mesh filter bag, and the third filter stage includes a pleated filter element.

13. The mobile debris collection machine of claim 12 wherein openings in said mesh filter bag are smaller than openings in said rotating filter element and openings in said pleated filter element are smaller than opening in said mesh filter bag.

14. A mobile debris collection machine having an improved filter system including a chassis, a debris collection pickup on said chassis, a debris container on said chassis, a vacuum system for carrying dust and debris from said pickup to said container, said vacuum system including a housing associated with said container and having a dust and debris inlet opening therein above said container, an outlet in said housing, a vacuum fan for creating an air stream that moves dust and debris into said housing and moves dust out of said housing, a filter system for removing dust from said air stream and depositing debris into said container, said filter system including multiple filter stages downstream of said debris container allowing air to exit the machine after passing through all of the multiple filter stages during a normal operation condition, and a bypass door allowing air to exit the machine after passing through at least one but not all of the multiple filter stages during a bypass condition.

15. A method of collecting debris with a machine including the steps of:

providing a chassis, a debris container on said chassis, and a vacuum system for carrying dust and debris to said container, wherein said vacuum system comprises a vacuum fan;

operating the vacuum fan to create an air stream that moves dust and debris into said container and moves dust out of said container;

providing a filter system including multiple filter stages downstream of said debris container;

removing dust from said air stream and depositing debris into said container;

allowing air to exit the machine after passing through all of the multiple filter stages during a normal operation condition; and allowing air to exit the machine though a bypass door after passing through at least one but not all of the multiple filter stages during a bypass condition.

16. A method of debris collection with a mobile machine, including the steps of:

providing a chassis, a debris container on said chassis, a debris collection pickup on said chassis, and a vacuum system for carrying dust and debris from said pickup to said container, said vacuum system including a vacuum fan;

operating the vacuum fan to create an air stream that moves dust and debris into said container and moves dust out of said container;

providing a filter system including a first filter stage having a rotatable filter element proximate to the container, and a second filter stage located downstream of said vacuum fan;

removing dust and debris from said air stream and depositing debris into said container; and rotating the rotatable filter element to separate debris from the air stream prior to the second filter stage.

* * * * *